US007667593B1

(12) United States Patent
Hummer

(10) Patent No.: US 7,667,593 B1
(45) **Date of Patent: *Feb. 23, 2010**

(54) CONTAINER MONITORING DEVICE

(76) Inventor: Gregory J. Hummer, 19815 N. Park Blvd., Shaker Heights, OH (US) 44122

( * ) Notice: Subject to any disclaimer, the term of this patent is extended or adjusted under 35 U.S.C. 154(b) by 0 days.

This patent is subject to a terminal disclaimer.

(21) Appl. No.: 11/705,142

(22) Filed: Feb. 9, 2007

Related U.S. Application Data

(63) Continuation of application No. 10/998,324, filed on Nov. 29, 2004, now Pat. No. 7,176,793.

(51) Int. Cl.
*G08B 1/08* (2006.01)

(52) U.S. Cl. ..... 340/539.13; 340/539.1; 340/539.17; 340/539.26; 340/541; 340/426.19; 340/825.49; 340/825.69

(58) Field of Classification Search ..... 340/539.13, 340/539.1, 539.17, 539.26, 531, 540, 541, 340/426.1, 426.19, 426.22, 825.49, 825.69, 340/568.1, 686.1
See application file for complete search history.

(56) References Cited

U.S. PATENT DOCUMENTS 7,109,859 B2 * 9/2006 Peeters ..... 340/539.11
7,151,447 B1 * 12/2006 Willms et al. ..... 340/540

* cited by examiner

*Primary Examiner*—Hung T. Nguyen
(74) *Attorney, Agent, or Firm*—Fay Sharpe LLP

(57) ABSTRACT

A monitoring system for cargo containers coming into the United States from foreign countries, to detect any harmful contents, within the close container, which would prove dangerous to the American people. The system includes a unique flexible plastic strip in which are embedded, 1) a global positioning computer chip, 2) a power source, 3) an encrypted strip serial number computer chip, and thousands of nano detection devices.

17 Claims, 1 Drawing Sheet

CONTAINER MONITORING DEVICE

This continuation application claims the priority benefit of U.S. application Ser. No. 10/998,324, filed Nov. 29, 2004, now U.S. Pat. No. 7,176,793, the disclosure of which is incorporated herein by reference.

BACKGROUND OF THE INVENTION

The invention relates generally to container packaging, and more particularly to cargo containers which are used to ship products, foodstuffs, and other materials into the United States of America from foreign countries outside the United States. The contents of such containers has become critical in the war against terrorism. It has become extremely important to monitor the contents of such containers for harmful materials, such as explosives, harmful biological material, and radiation materials. The invention is designed to monitor the contents of large or small containers for any harmful materials.

Briefly stated, the invention is in one or more detection devices which are initially placed within a container, depending on the size of the container. The detection devices are designed to send off specific resonant frequency signals which are correlated to any harmful material detected within the container. A hand held or stationary monitor is provided to monitor the container for any signals given off from the detection devices within the container. The detection devices are designed to give off a predetermined amount of background signal. So that if no such signals are received, the container is highly suspect as being tampered with, and such container is quickly removed and its contents examined.

DESCRIPTION OF THE DRAWINGS

The following description of the invention will be better understood by having reference to the accompanying drawing wherein.

DETAILED DESCRIPTION OF THE DRAWINGS

Figure 1:
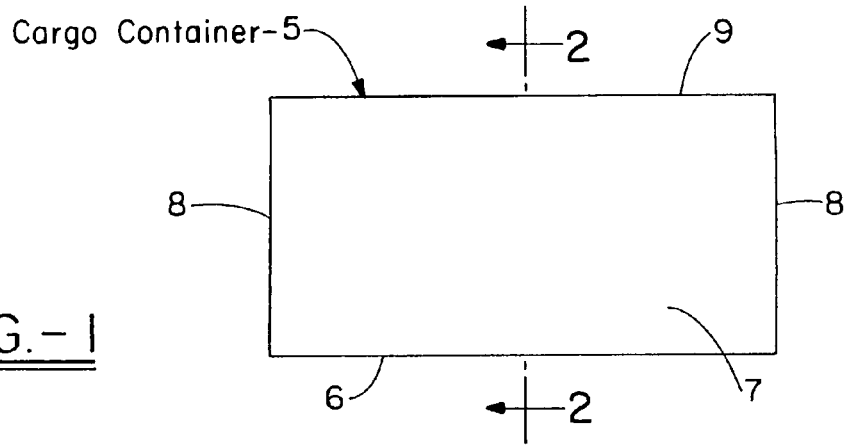
FIG. 1 is a side view of a typical cargo container.
Figure 2:
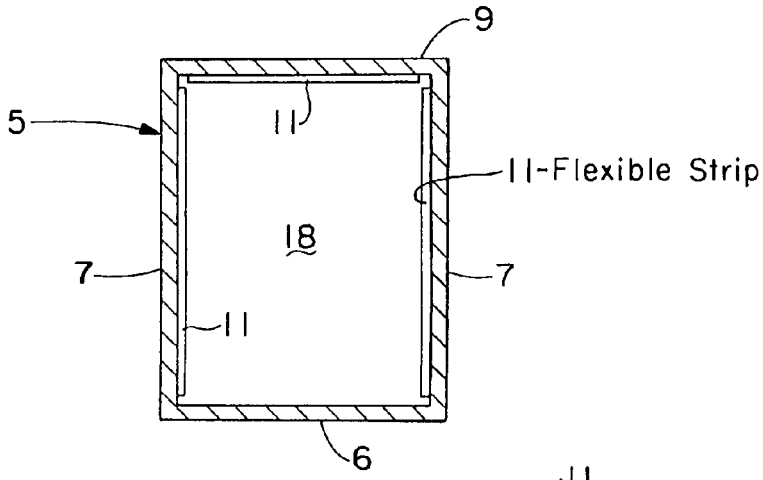
FIG. 2 is an enlarged cross section of the cargo container, as viewed from the plane 2-2 of FIG. 1.
Figure 3:
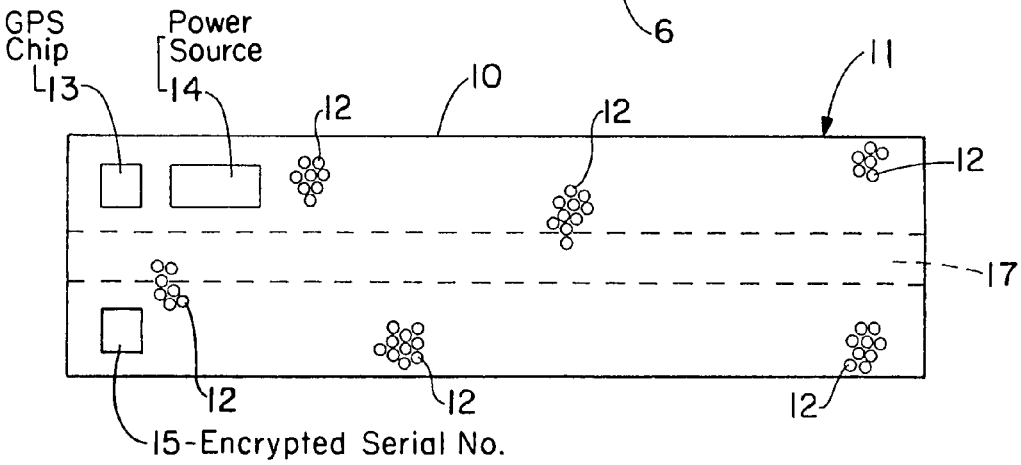
FIG. 3 is a side view of a detection device which is made in accordance with the invention.

With reference to FIGS. 1-3 of the drawing, there is shown a container 5 which can be of any size, including large cargo containers in connection with which the invention is described, Cargo containers 5 are preferably made of meta and each one is comprised of a bottom 6 with a pair of opposing, upstanding similar sides 7 and a pair of similar opposing ends 8, and a top 9 for covering and closing the cargo container 5.

Depending on the size of the container 5, one or more detection devices 10 are placed within the container 5 to detect any harmful materials, such as explosives, radioactive materials, and harmful chemicals and biological gases and germs. The detection device 10 of the invention, as best seen in FIG. 3, comprises a flexible strip 11, which is composed of any suitable plastic material in which is embedded many thousands of nano detection devices 12 which combine to detect many different harmful materials, some of which are enumerated above, and produce and transmit resonant frequencies corresponding to the harmful materials detected.

A global positioning system (GPS) computer chip 13 is also embedded in the detection strip 11 as well as a low voltage motion activated power source 14, and an encrypted serial numbered (ESN) computer chip 15.

The GPS chip 13 stores not only the origin of a particular container 5, but tracks the route which the container 5 travels from said origin to its destination which, for our purposes, is the United States. This information can be readily accessed from the GPS chip 13. The ESN chip 15 stores and transmits, information about the condition of the nano detectors and an encrypted serial number that is specific to the one or more particular detection strips 11, which are assigned to the container 5 involved. The ESN chip 15 produces and transmits a distinct resonant frequency which can be accessed and used to track down the owner of the detection strips 11 within the container 5, since the owner of every detection strip 11 is maintained. The container 5, when moved, will activate the power source 14 to maintain operation of the detection strip 11.

Figure 4:
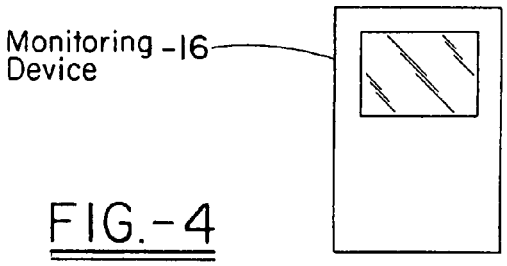
FIG. 4 is a plan view of a monitoring device.

Any suitable hand-held or stationary monitoring device 16 (FIG. 4) is used to monitor the resonant frequencies produced and transmitted by the nano detectors 10 and the GPS and ESN computer chips 13 and 15 to reveal the contents of a container 5, whether the contents be good or bad. The monitoring device 16 will be able to detect a separate and distinct calibrated general background resonant frequency from some of the numerous nano detectors 12, embedded in the detection strip 11, as a means to ensure that the detection strip 11 is functioning. If not, the container 5 is suspect and removed to a remote location for further examination and review or, in some cases, the suspected container 5 may be rejected and sent back to its place of origin. The monitoring devices 16 are designed to translate the resonate frequencies received into digital readouts on a screen of the monitoring device 16, and printouts at a remotely located printer, if desired.

The detection strips 11 each have a sticky side which can firmly adhere to sides of the container 5. When not in use, the sticky side of the detection strip 11 is covered by a protective strip which can be peeled away when the strip 11 is ready to be applied to the container 5, The sticky side of each detection strip 11 is provided with one or a number of metal studs or strips 17 for contact with the metal sides 7 and top 9 of a container 5 to facilitate or improve the transmission of the resonant frequencies from the detection strips 11 to a monitoring device 16 outside the container 5. For example, a single, continuous metal strip or stud 17 may be placed longitudinally of the detection strip 11 between the opposing marginal edges of the detection strip 11, as shown in dotted line in FIG. 3, or a .a number of similar, short metal studs 17 may be spaced longitudinally of the detection strip 11 in transversely oriented relation on the detention strip 11.

Thus, there has been described a unique detection strip 11 that is placed within an enclosed space 18 of a container 11 to detect any solids, liquids, or gases which may prove to be harmful to human beings. It is estimated that three separate detection strips 11, disposed against the top 5 and adjacent two sides 7, midway between the opposing ends 8 of the container 5, may be sufficient to detect such harmful materials in a standard size cargo containers 5. Each detection strip 11 should have its own distinct ESN computer chip 15. Otherwise, there would be no way to tell if one of the ESN computer chips 15 was destroyed or removed from the container 5, if all three ESN computer chips 15 were identical and transmitted the same resonant frequency.

What is claimed is:

1. A detection strip for an enclosed container, comprising many detectors that can be as small as nano detectors, for detecting materials, harmful to human beings, within an enclosed container and transmitting a corresponding resonance frequency.

2. The detection strip of claim 1, which includes an encrypted serial numbered (ESN) computer chip which stores and transmits information about a condition of the nano detectors and an encrypted serial number that is specific to the one or more particular detection strips which is attached to the strip.

3. The detection strip of claim 2, which includes a global positioning system computer chip for identifying origin and travel of the strip and container to which the strip is attached.

4. The detection strip of claim 3, which includes a power source which is a low voltage, motion activated, power source.

5. The detection strip of claim 4, wherein the strip is calibrated to produce and transmit a distinct resonant frequency which is independent of any other frequencies transmitted from the detection strip.

6. The detection strip of claim 5, which includes at least one metal stud embedded in a sticky side of the strip for contacting metal walls of the container to facilitate and improve transmission of resonant frequencies from the detection strip inside a container.

7. The detection strip of claim 6, wherein the nano detectors thereof are designed to detect harmful materials of the group of harmful explosive, chemical, biological and radioactive materials, and illegal drugs.

8. The detection strip of claim 7, in combination with a monitoring device for receiving resonant frequencies from the detection strip and translating such frequencies into digital readouts on the monitoring device and further printouts by printers which may be remote from the monitoring device.

9. The detection strip of claim 8, wherein the monitoring device is stationary and remote from a container inside which a detection strip is located.

10. The detection strip of claim 9, wherein the monitoring device is a hand held device which is outside a container in which a detection strip is located.

11. The detection strip of claim 10, further in combination with an enclosed container which needs monitoring for said harmful materials.

12. The detection strip of claim 11, wherein the container is a standard, metal cargo container in which foreign products and foodstuffs are shipped into the United States of America.

13. The detection strip of claim 12, wherein a plurality of detection strips are used in every metal cargo contained entering the United States.

14. In combination:

a) a cargo container in which any suitable cargo is placed for transport from one place to another place;

b) a strip of material disposed in the container for detecting any tampering with the container, the strip including numerous nano detectors which are designed to transmit a predetermined frequency;

c) means of storing and transmitting information about the condition of the nano detectors and the serial number of the strip using an ESN computer chip;

d) a global positioning computer chip carried by the strip for identifying origin and travel of the container; and e) a power source for operating the strip.

15. The combination of claim 14, which includes means outside the container for receiving any frequencies transmitted from inside the container.

16. The strip of claim 1 which includes means for measuring said resonant frequency.

17. The strip of claim 1, which includes means for measuring electrical voltage produced by said resonant frequency.

* * * * *